US010295951B2

(12) United States Patent
Sato et al.

(10) Patent No.: US 10,295,951 B2
(45) Date of Patent: May 21, 2019

(54) CLEANING BLADE, CLEANING DEVICE AND IMAGE FORMING APPARATUS

(71) Applicant: CANON KABUSHIKI KAISHA, Tokyo (JP)

(72) Inventors: Genta Sato, Kawasaki (JP); Isao Komatsu, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/973,779

(22) Filed: May 8, 2018

(65) Prior Publication Data

US 2018/0329355 A1 Nov. 15, 2018

(30) Foreign Application Priority Data

May 9, 2017 (JP) ..... 2017-093324

(51) Int. Cl.
*G03G 21/00* (2006.01)

(52) U.S. Cl.
CPC . *G03G 21/0088* (2013.01); *G03G 2221/0005* (2013.01); *G03G 2221/1606* (2013.01)

(58) Field of Classification Search
CPC ..... G03G 21/0088
USPC ..... 399/348, 350
See application file for complete search history.

(56) References Cited

U.S. PATENT DOCUMENTS 4,043,659 A * 8/1977 Wilson ..... G03G 21/0088 399/348
5,470,635 A * 11/1995 Shirai ..... G03G 21/0011 399/350
2013/0236208 A1 9/2013 Komatsu

FOREIGN PATENT DOCUMENTS

JP 2004-286868 A 10/2004
JP 2005-189555 A 7/2005
JP 2006-113353 A 4/2006

OTHER PUBLICATIONS

U.S. Appl. No. 15/881,964, filed Jan. 29, 2018 (First Named Inventor: Isao Karnatsu).

* cited by examiner

*Primary Examiner* — William J Royer
(74) *Attorney, Agent, or Firm* — Venable LLP

(57) ABSTRACT

A cleaning blade for a photosensitive member carrying a liquid developer includes a free end surface provided at one end portion in a height direction of the blade, the free end surface being provided with an edge portion at one end portion of the free end surface with respect to the thickness direction. The edge portion has curved portions and a linear portion therebetween. As seen in the thickness direction, the curved portion includes an arcuate shape portion and is connected with the linear portion such that the linear portion is tangential of the arcuate shape; a height of the blade increases toward the end portion of the blade; a maximum angle formed between the curved portion and the linear portion is not less than 5 degrees; and the curved portion includes a portion having radius of curvature not less than 240 mm and not more than 320 mm.

20 Claims, 5 Drawing Sheets

(a)

(b)

(a) COMP. EX. 1

(b) COMP. EX. 2

(c) COMP. EX. 3

CLEANING BLADE, CLEANING DEVICE AND IMAGE FORMING APPARATUS

FIELD OF THE INVENTION AND RELATED ART

The present invention relates to a cleaning blade and a cleaning device, which are employed by a copying machine, a facsimileing machine, a printing machine, and the like image forming apparatuses, which form an image with the use of liquid developer.

There are various image forming apparatuses which use an electrophotographic image forming method, or the like. Among these apparatuses, there are image forming apparatuses of the so-called wet-type, which form an electrostatic latent image on their image bearing member, such as a photosensitive drum, and develop the electrostatic latent image with the use of liquid developer which is made up of toner and liquid carrier, in order to form images. In the case of these image forming apparatuses of the wet-type, a cleaning blade (which hereafter may be referred to as "blade") is placed in contact with the peripheral surface of their image bearing member to scrape away liquid developer from the peripheral surface of the image bearing member. More specifically, the blade is a piece of plate formed of an elastic substance, and its cleaning edge portion is placed in contact with the peripheral surface of the image bearing member. Generally speaking, it is disposed in contact with the peripheral surface of the image bearing member in such a manner that, in terms of the moving direction of the peripheral surface of the image bearing member, its cleaning edge is on the upstream side of its base portion.

After the liquid developer on the peripheral surface of the image bearing member is scraped away by one of the edges of the blade, it moves in the lengthwise direction (toward the lengthwise ends) of the blade, following the minute gaps between the peripheral surface of the image bearing member and the blade (capillary phenomenon), while spreading in the lengthwise direction of the blade. As it reaches the lengthwise ends of the blade, it moves onto the lengthwise end surfaces of the blade, and forms "liquid rings", which extend on the peripheral surface of the image bearing member, in the circumferential direction of the image bearing member. The formation of the "liquid rings" on the peripheral surface of the image bearing member is one of the causes of the contamination of a developing apparatus, a charging apparatus, an exposing apparatus, and so on, which act on the image bearing member. The contamination of these apparatuses sometimes reduces an image forming apparatus of the wet-type in image quality.

There is disclosed in Japanese Laid-open Patent Application No. 2005-189555, a cleaning blade capable of preventing the formation of the "liquid rings". In the case of this blade, the lengthwise end portions of its cleaning edge are provided with such a curvature that the closer to the lengthwise end of the blade, the wider the blade.

This blade, however, has the following problem. That is, if the lengthwise end portions of the cleaning edge of the blade are relatively small in radius of curvature, the contact pressure between each of these portions of the blade may sometimes be smaller than a value which is necessary to satisfactorily remove the liquid developer. Further, it was discovered that if a part of the area of contact between the lengthwise end portions (having curvature) of the cleaning edge and the peripheral surface of the image bearing member are smaller in contact pressure (liner pressure) than a value required for satisfactory cleaning of the blade, a certain amount of liquid developer sometimes escapes to the downstream side of the blade through the gaps between the blade and the peripheral surface of the image bearing member. Further, it occurs sometimes that if the point of connection between the straight portion (center portion) of the cleaning edge and the lengthwise end portion (having curvature) of the cleaning edge is not smooth, the point of contact is smaller in the contact pressure between the blade and image bearing member than a value necessary for satisfactory cleaning of the image bearing member, and therefore, a certain amount of liquid developer escapes to the downstream side of the blade through the gaps between the blade and image bearing member.

SUMMARY OF THE INVENTION

According to an aspect of the present invention, there is provided a plate-like cleaning blade of elastic member capable of removing deposited matter from an image bearing member carrying a liquid developer, the cleaning blade comprising a free end surface provided at one end portion with respect to a height direction of said cleaning blade which is perpendicular to a longitudinal direction of said cleaning blade and to a thickness direction of said cleaning blade, said free end surface being provided with an edge portion at one end portion of said free end surface with respect to the thickness direction, wherein said edge portion has a curved portion extending from each end portions of said edge portion with respect to the longitudinal direction in a predetermined range, and a linear portion extending in the longitudinal direction between said curved portions and connecting with said curved portions at the respective connecting positions, wherein as said cleaning blade is seen in the thickness direction, a) said curved portion includes a portion having an arcuate shape, b) said curved portion is connected with said linear portion such that said linear portion is tangential of the arcuate shape, c) a height of said cleaning blade measured in the height direction in the range in which said curved portion is provided increases toward the end portion of said cleaning blade, d) a maximum angle formed between said curved portion and said linear portion is not less than 5 degrees, and e) said curved portion includes a portion having a radius of curvature not less than 240 mm and not more than 320 mm.

According to another aspect of the present invention, there is provided a cleaning device capable of removing deposited matter from an image bearing member carrying a liquid developer, said cleaning device comprising a plate-like cleaning blade of elastic member, said cleaning blade including a free end surface provided at one end portion with respect to a height direction of said cleaning blade which is perpendicular to a longitudinal direction of said cleaning blade and to a thickness direction of said cleaning blade, said free end surface being provided with an edge portion at one end portion of said free end surface with respect to the thickness direction, wherein said edge portion has a curved portion extending from each end portions of said edge portion with respect to the longitudinal direction in a predetermined range, and a linear portion extending in the longitudinal direction between said curved portions and connecting with said curved portions at the respective connecting positions, wherein as said cleaning blade is seen in the thickness direction, a) said curved portion includes a portion having an arcuate shape, b) said curved portion is connected with said linear portion such that said linear portion is tangential of the arcuate shape, c) a height of said cleaning blade measured in the height direction in the range in which said curved portion is provided increases toward the end portion of said cleaning blade, d) a maximum angle formed between said curved portion and said linear portion is not less than 5 degrees, and e) said curved portion includes a portion having a radius of curvature not less than 240 mm and not more than 320 mm; and a container portion for temporarily containing the liquid developer removed by said cleaning blade.

According to a further aspect of the present invention, there is provided an image forming apparatus using a liquid developer, said apparatus comprising a movable image bearing member; an image forming portion for forming a toner image on said image bearing member using the liquid developer; a plate-like cleaning blade of elastic member having an edge portion contacted to said image bearing member at a contact portion and configured to remove a deposited matter from said image bearing member with movement of said image bearing member, wherein said cleaning blade includes a free end surface provided at one end portion with respect to a height direction of said cleaning blade which is perpendicular to a longitudinal direction of said cleaning blade and to a thickness direction of said cleaning blade, said free end surface being provided with said edge portion at one end portion of said free end surface with respect to the thickness direction, wherein said edge portion has a curved portion extending from each end portions of said edge portion with respect to the longitudinal direction in a predetermined range, and a linear portion extending in the longitudinal direction between said curved portions and connecting with said curved portions at the respective connecting positions, wherein as said cleaning blade is seen in the thickness direction, a) said curved portion includes a portion having an arcuate shape, b) said curved portion is connected with said linear portion such that said linear portion is tangential of the arcuate shape, c) a height of said cleaning blade measured in the height direction in the range in which said curved portion is provided increases toward the end portion of said cleaning blade, d) a maximum angle formed between said curved portion and said linear portion is not less than 5 degrees, and e) said curved portion includes a portion having a radius of curvature not less than 240 mm and not more than 320 mm; and a container portion for temporarily containing the liquid developer removed by said cleaning blade.

According to a further aspect of the present invention, there is provided a plate-like cleaning blade of elastic member capable of removing deposited matter from an image bearing member carrying a liquid developer, said cleaning blade comprising a free end surface provided at one end portion with respect to a height direction of said cleaning blade which is perpendicular to a longitudinal direction of said cleaning blade and to a thickness direction of said cleaning blade, said free end surface being provided with an edge portion at one end portion of said free end surface with respect to the thickness direction, wherein said edge portion has an inclined portion extending from each end portions of said edge portion with respect to the longitudinal direction in a predetermined range, and a linear portion extending in the longitudinal direction between said inclined portions and connecting with said inclined portions at the respective connecting positions, wherein as said cleaning blade is seen in the thickness direction, a) an inclined portion is provided by serially connecting N linear connecting portions, where N is not less than 4, b) a height of said cleaning blade measured in the height direction in the range in which said inclined portion is provided increases toward the end portion of said cleaning blade, c) the connecting portion at a position closer to the end portions of said cleaning blade is inclined more relative to said linear portion, d) an angle formed between adjacent connecting portions is smaller than an angle of the connecting portion closest to the end portions of said cleaning blade in the longitudinal direction relative to the linear portion divided by N−1, and e) an angle of the connecting portion closest to the end portions relative to the linear portion is not less than 5 degrees.

According to a further aspect of the present invention, there is provided a cleaning device capable of removing deposited matter from an image bearing member carrying a liquid developer, said cleaning device comprising a plate-like cleaning blade of elastic member, said cleaning blade including a free end surface provided at one end portion with respect to a height direction of said cleaning blade which is perpendicular to a longitudinal direction of said cleaning blade and to a thickness direction of said cleaning blade, said free end surface being provided with an edge portion at one end portion of said free end surface with respect to the thickness direction, wherein said edge portion has an inclined portion extending from each end portions of said edge portion with respect to the longitudinal direction in a predetermined range, and a linear portion extending in the longitudinal direction between said inclined portions and connecting with said inclined portions at the respective connecting positions, wherein as said cleaning blade is seen in the thickness direction, a) an inclined portion is provided by serially connecting N linear connecting portions, where N is not less than 4, b) a height of said cleaning blade measured in the height direction in the range in which said inclined portion is provided increases toward the end portion of said cleaning blade, c) the connecting portion at a position closer to the end portions of said cleaning blade is inclined more relative to said linear portion, d) an angle formed between adjacent connecting portions is smaller than an angle of the connecting portion closest to the end portions of said cleaning blade in the longitudinal direction relative to the linear portion divided by (N−1), and e) an angle of the connecting portion closest to the end portions relative to the linear portion is not less than 5 degrees; and a container portion for temporarily containing the liquid developer removed by said cleaning blade.

According to a further aspect of the present invention, there is provided an image forming apparatus using a liquid developer, said apparatus comprising: a movable image bearing member; an image forming portion for forming a toner image on said image bearing member using the liquid developer; a plate-like cleaning blade of elastic member having an edge portion contacted to said image bearing member at a contact portion and configured to remove a deposited matter from said image bearing member with movement of said image bearing member, wherein said cleaning blade includes a free end surface provided at one end portion with respect to a height direction of said cleaning blade which is perpendicular to a longitudinal direction of said cleaning blade and to a thickness direction of said cleaning blade, said free end surface being provided with said edge portion at one end portion of said free end surface with respect to the thickness direction,wherein said edge portion has an inclined portion extending from each end portions of said edge portion with respect to the longitudinal direction in a predetermined range, and a linear portion extending in the longitudinal direction between said inclined portions and connecting with said inclined portions at the respective connecting positions, wherein as said cleaning blade is seen in the thickness direction, a) inclined portion is provided by serially connecting N linear connecting portions, where N is not less than 4, b) a height of said cleaning blade measured in the height direction in the range in which said inclined portion is provided increases toward the end portion of said cleaning blade, c) the connecting portion at a position closer to the end portions of said cleaning blade is inclined more relative to said linear portion, d) an angle formed between adjacent connecting portions is smaller than an angle of the connecting portion closest to the end portions of said cleaning blade in the longitudinal direction relative to the linear portion divided by (N−1), and e) an angle of the connecting portion closest to the end portions relative to the linear portion is not less than 5 degrees; and a container portion for temporarily containing the liquid developer removed by said cleaning blade.

Further features of the present invention will become apparent from the following description of exemplary embodiments with reference to the attached drawings.

BRIEF DESCRIPTION OF THE DRAWINGS

Parts (a) and (b) of FIG. 1 are a combination of a perspective view (a) of the blade and its adjacencies in the first embodiment of the present invention, and a top view (b) of the blade (one of lengthwise ends of blade).

Figure 4:
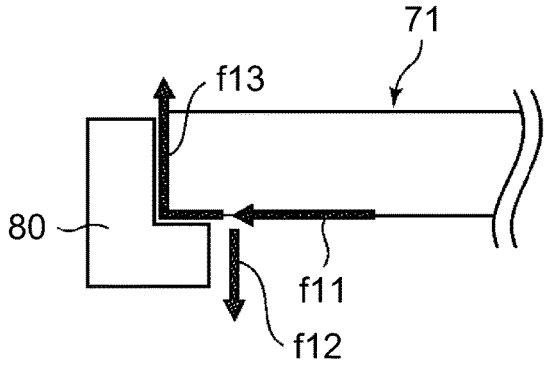
Figure 4:
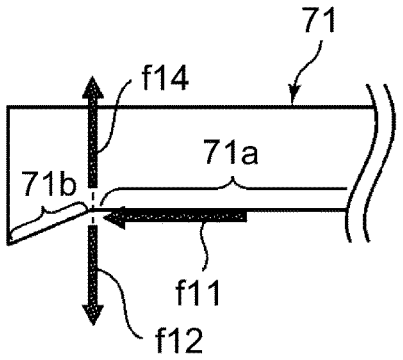
Figure 4:
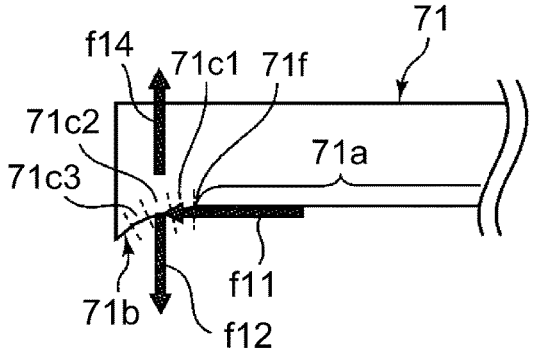

Parts (a), (b) and (c) of FIG. 4 are a combination of schematic top views of the lengthwise portions of the comparative blades; it is for showing the flow of liquid developer in the lengthwise end portion of the blade.

Figure 5:
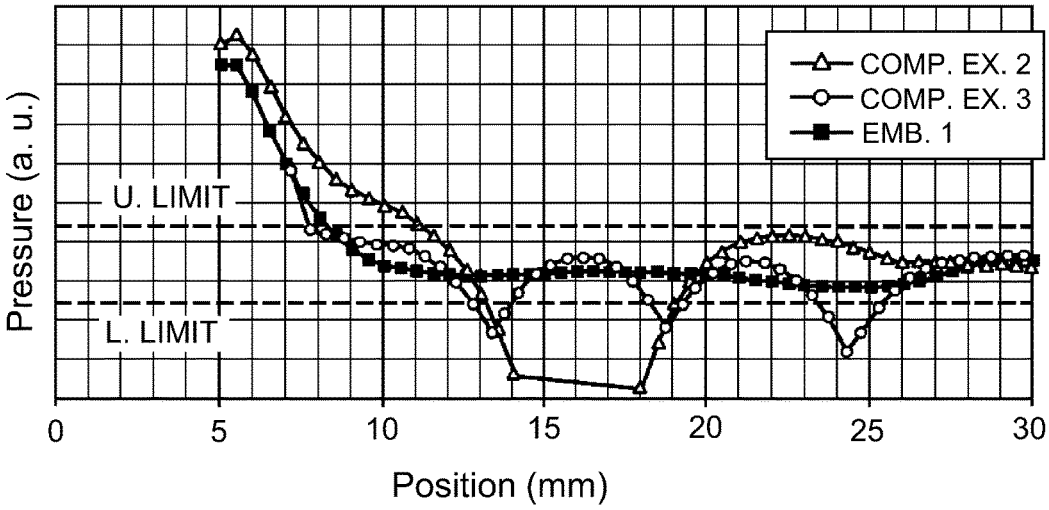

FIG. 5 is a graph which shows the distribution of the contact pressure between the blade and image bearing member in the first embodiment, and that between the comparative blades and image bearing member.

Figure 6:
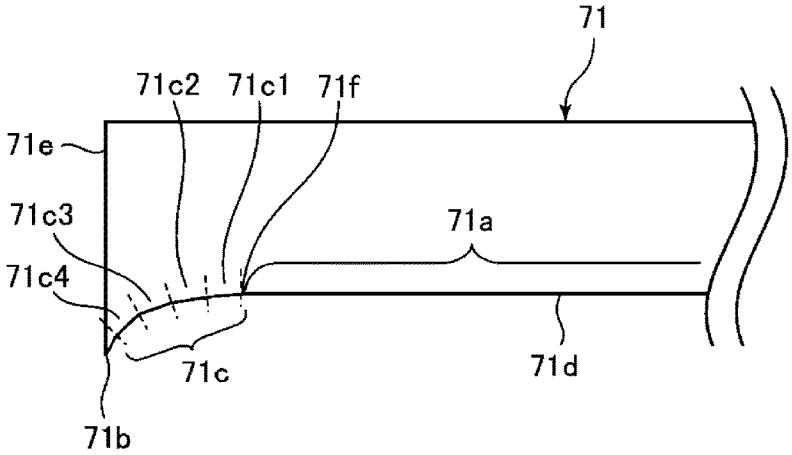

FIG. 6 is a top view of the blade (one of lengthwise end portions) in another embodiment of the present invention.

Figure 7:
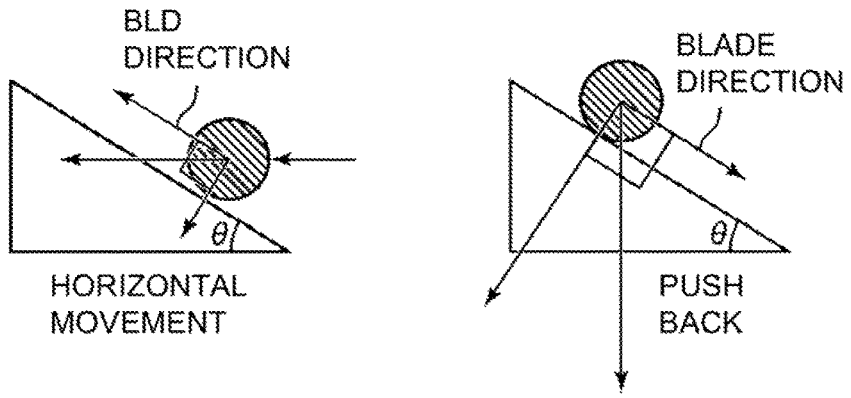

FIG. 7 is a drawing for schematically describing the concept of how the angle of the slanted portion is to be set.

Figure 8:
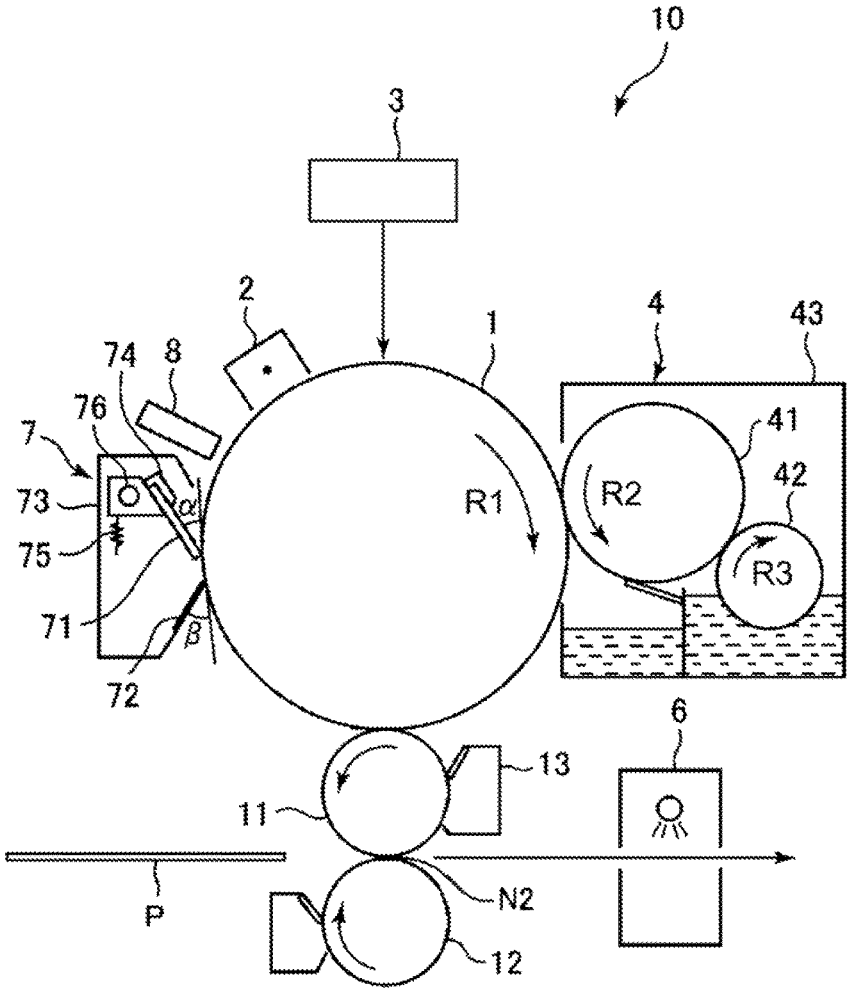

FIG. 8 is a schematic sectional view of another image forming apparatus to which the present invention is applicable.

DESCRIPTION OF THE EMBODIMENTS

Hereinafter, the present invention is described in greater detail with reference to the drawings of the cleaning device and image forming apparatus, which are in accordance with the present invention.

[Embodiment 1]

Figure 2:
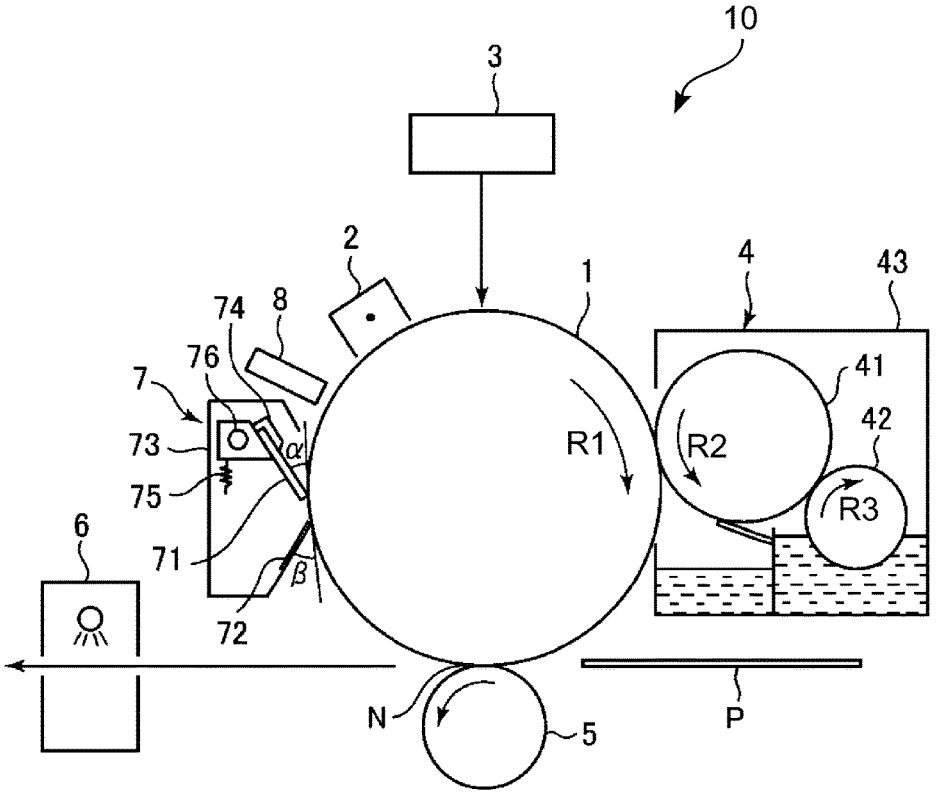
FIG. 2 is a schematic sectional view of the image forming apparatus in the first embodiment.

1. Overall Structure of Image Forming Apparatus, and Operation of Image Forming Apparatus FIG. 2 is a schematic sectional view of the image forming apparatus in this embodiment. The image forming apparatus 10 in this embodiment is an electrophotographic image forming apparatus of the so-called wet-type, which forms images with the use of liquid developer. By the way, the gravity works in the downward direction in FIG. 2.

The image forming apparatus 10 has a photosensitive drum 1, as a rotatable image bearing member, that is, a photosensitive member (electrophotographic photosensitive member) which is in the form of a drum (cylindrical). The photosensitive drum 1 is rotationally driven in the direction indicated by an arrow mark R1 in the drawing at a preset peripheral velocity. By the way, in this embodiment, the peripheral velocity of the photosensitive drum 1 is equivalent to the process speed of the image forming apparatus 10. Further, in this embodiment, the peripheral velocity at which the photosensitive drum 1 is rotated during an image forming operation is 800 mm/sec. The photosensitive drum 1 is 84 mm in diameter, 380 mm in length in terms of the direction parallel to its rotational axis. It is formed of amorphous silicon. As the photosensitive drum 1 is rotated, its peripheral surface is uniformly charged to a preset polarity and a preset potential level (pre-exposure potential level) by a charging device 2 as a charging means. The uniformly charged peripheral surface of the photosensitive drum 1 is exposed by an exposing apparatus 3 (laser-based optical system) as an exposing means (means for forming latent image). More specifically, the uniformly charged peripheral surface of the photosensitive drum 1 is scanned by (exposed to) a beam of laser light outputted by the exposing apparatus 3 while being modulated by image formation signals. Consequently, an electrostatic (electrostatic image) latent image is formed on the peripheral surface of the photosensitive drum 1. Then, the electrostatic latent image is developed by a developing apparatus 4, as a developing means, into a toner image; a visible image is formed of toner on the peripheral surface of the photosensitive drum 1.

The developing apparatus 4 has a developer container 43 which holds liquid developer (development liquid) which is made up of carrier liquid (medium in the form of liquid), and particulate toner dispersed in the carrier liquid. The developing apparatus 4 is also provided with a development roller 41, as a developer bearing member, which is rotatably attached to the developer container 43. In this embodiment, the development roller 41 is 40 mm in diameter and 350 mm in length in terms of the direction parallel to the rotational axis of the photosensitive drum 1. It is formed of electrically conductive urethane rubber. Further, the developing apparatus 4 is also provided with a coating roller 42 for coating the development roller 41 with the liquid developer. The coating roller 42 is rotatably attached to the developer container 43. The development roller 41 and coating roller 42 are rotationally driven in the directions indicated by arrow marks R2 and R3, respectively, in the drawing. The development roller 41 is disposed so that its peripheral surface faces the peripheral surface of the photosensitive drum 1. It is coated with liquid developer by the coating roller 42, across its peripheral surface, and then, it conveys the liquid developer on its peripheral surface to the area (development area) in which the peripheral surface of the development roller 41 faces the peripheral surface of the photosensitive drum 1, to supply the electrostatic latent image on the peripheral surface of the photosensitive drum 1, with liquid developer. By the way, the toner image on the photosensitive drum 1 is formed of toner particles, and the carrier liquid in the adjacencies of the toner particles. During a development process, a preset development bias is applied to the development roller 41 so that the liquid developer is moved from the development roller 41 onto the photosensitive drum 1 by the electric field generated by the development bias. By the way, the developing apparatus 4 is supplied with liquid developer as necessary by an unshown liquid developer delivery apparatus. Toner is made up of coloring agents, and the bonding resin in which the coloring agents are dispersed. As the carrier liquid, such liquid that is curable with ultraviolet light or thermally curable is used. In this embodiment, liquid which is curable with ultraviolet light was used. The liquid used as the carrier liquid in this embodiment was 4 cp in viscosity. The toner density (ratio, in terms of weight, of toner relative to entirety of liquid developer) of the liquid developer to be supplied to the developing apparatus 4 is in a range of 1-20%.

The toner image formed on the peripheral surface of the photosensitive drum 1 is conveyed to a transferring portion N (transfer nip), which is the area of contact between the photosensitive drum 1, and a transfer roller 5 as a transferring means. Then, it is transferred onto a sheet P of transfer medium while the sheet P is conveyed, remaining sandwiched between the photosensitive drum 1 and transfer roller 5, in the transferring portion N. The transfer roller 5 is rotated by the rotation of the photosensitive drum 1. During a transferring process, a preset transfer bias is applied to the transfer roller 5 so that the electric field generated by the transfer bias is utilized to move the liquid developer from the photosensitive drum 1 onto the sheet P. The sheet P is delivered by an unshown transfer medium feeding-conveying apparatus, with such timing that the sheet P arrives at the transferring portion N at the same time as the toner image on the photosensitive drum 1. In this embodiment, the transfer medium is coated sheet of paper which is roughly 128 g/m$^2$, for example, in basis weight.

After the transfer of the toner image onto a sheet P of transfer medium, the sheet P is conveyed to a fixing apparatus 6 as a fixing means, in which the toner image on the sheet P is fixed to the sheet P. After the fixation of the toner image to the sheet P, the sheet P is discharged out of the main assembly of the image forming apparatus 10. In this embodiment, the fixing apparatus 6 illuminates the sheet P, which is bearing a toner image, with ultraviolet light to harden the carrier liquid in order to fix the toner image to the sheet P.

As for the liquid developer which was not transferred onto a sheet P of transfer medium from the photosensitive drum 1 during a transferring process, that is, the liquid developer (which contains toner and carrier liquid) remaining on the photosensitive drum 1 after the transferring process, is removed from the photosensitive drum 1, and recovered, by a cleaning device 7 as a cleaning means. Further, after the cleaning of the peripheral surface of the photosensitive drum 1 by the cleaning device 7, the peripheral surface of the photosensitive drum 1 is illuminated by the light from a discharge lamp 8 as a discharging means so that the roughly entirety of the peripheral surface of the photosensitive drum 1 is completely discharged.

2. Cleaning Device

Next, the cleaning device 7 is described about its structure. In this embodiment, the cleaning device 7 has a blade 71 (cleaning blade), a scooping sheet 72, and a casing 73 (which hereafter is referred to as recovered developer container, or simply as "recovery container").

The blade 71 is such a cleaning member that is placed in contact with the peripheral surface of the photosensitive drum 1 (which is rotational member by which liquid developer is borne) to scrape liquid developer away from the peripheral surface of the photosensitive drum 1. The blade 71 is fixed to a blade attachment metallic plate 74, as a blade anchoring member, which is pivotally movable about a shaft 76 attached to the recovery container 73 (casing 73). The blade attachment metallic plate 74 is under the pressure generated by a pressure application spring 75, as a pressure applying means. Thus, the blade 71 remains pressed upon the peripheral surface of the photosensitive drum 1 by a preset amount of pressure (necessary to satisfactorily dam up liquid developer) to clean the peripheral surface of the photosensitive drum 1. In this embodiment, this preset amount of pressure (which hereafter may be referred to as "contact pressure") which is necessary for the satisfactory cleaning is in a range of 25-40 gf/cm. The blade 71 is roughly in the form of a long and narrow rectangle piece of plate. It has preset length, width, and thickness. It is disposed so that its long edges become roughly parallel to the axial line of the photosensitive drum 1, and its short edges becomes roughly perpendicular to the rotational axis of the photosensitive drum 1. That is, it is roughly a long, narrow, and thin piece of plate formed of an elastic substance. In this embodiment, the blade 71 is formed of polyurethane rubber. It is 80 degrees in hardness (JIS-A hardness scale), 2 mm in thickness, 20 mm in width (within image formation range, which will be described later), and 376 mm in length. It is disposed so that its cleaning edge portion (one of edge portions which are perpendicular to widthwise direction of blade) is placed in contact with the peripheral surface of the photosensitive drum 1, and also, so that, in terms of the rotational direction of the photosensitive drum 1, its cleaning edge portion is on the upstream side of its base portion (by which it is attached to blade attachment metallic plate 74). In this embodiment, the blade 71 is fixed to the blade attachment metallic plate 74 by the other edge portion (which is perpendicular to widthwise direction), more specifically, the 10 mm wide (in terms of direction perpendicular to lengthwise direction of blade 71) strip of the base portion, which is parallel to the lengthwise direction of the blade 71. Also in this embodiment, the angle $\alpha$ of the surface of the blade 71 relative to the straight line which is tangential to the peripheral surface of the photosensitive drum 1 and coincides with the point of contact between the blade 71 and photosensitive drum 1, is set to 25 degrees. Also in this embodiment, the blade 71 is disposed so that its cleaning edge side, which is one of the edge portions in terms of its widthwise direction), is on the bottom side of the base side (other edge portion) (FIG. 2) in terms of the gravity direction, and also, so that the other edge portion, by which the blade 71 is fixed to the casing 73, is on the top side of the cleaning edge portion in terms of the gravity direction.

By the way, the contact pressure between the blade 71 and photosensitive drum 1 is expressed in terms of "linear pressure" (gf/cm), that is, the amount of load applied by the blade 71 upon the photosensitive drum 1 per unit length of the blade 71. The method used to measure this "linear" pressure is as follows: a load conversion device is attached to the photosensitive drum 1 or the like, so that the amount of the load applied to the peripheral surface of the photosensitive drum 1 by the blade 71 can be measured while the blade 71 is pressed upon the photosensitive drum 1. A value equivalent to the linear pressure (contact pressure) between the blade 71 and photosensitive drum 1 can also be obtained by structural simulation, as will be described later. Further, the amount of the contact pressure which is necessary for successful cleaning can be obtained by experiments, or the like. The minimum value for the contact pressure necessary for successful cleaning may be set so that the amount by which liquid developer is allowed to move to the downstream side of the blade 71 through between the blade 71 and photosensitive drum 1 (leakage) remains tolerable. Further, the maximum value for the contact pressure necessary for successful cleaning may be set for satisfactorily preventing the problem that the blade 71 vibrates (abnormal vibrations), and also, the cleaning edge portion of the blade 71 buckles in the downstream direction in terms of the rotational direction of the photosensitive drum 1.

In terms of the rotational direction of the photosensitive drum 1, the scooping sheet 72 is disposed on the upstream side of the blade 71. Further, it is disposed so that its scooping edge portion (one of long edges) extends in the lengthwise direction of the blade 71. It is such a sheet that scoops up the liquid developer as the liquid developer is scraped away from the peripheral surface of the photosensitive drum 1, and recovers the developer into the recovery container 73 (waste developer container). It is attached to the recovery container 73. It also is in the form of a long and narrow rectangle, having a preset dimension (length) in terms of the direction which is roughly parallel to the rotational axis of photosensitive drum 1, and a preset dimension (width which is roughly perpendicular to length) in terms of the direction which is roughly perpendicular to the rotational axis of photosensitive drum 1. It has a preset thickness. It is a piece of sheet (film) formed of a flexible substance. The desirable thickness of the scooping sheet 72 is in a range of 25 μm-125 μm.

In this embodiment, a sheet of PET (polyethylene-terephthalate) resin, which is 50 μm in thickness, 12 mm in width, and 362 mm in length is used as the scooping sheet 72. The scooping sheet 72 is disposed so that its scooping edge (one of long edges) is placed in contact with the peripheral surface of the photosensitive drum 1 in such an attitude that the scooping edge faces downstream in terms of the direction parallel to the rotational axis of photosensitive drum 1. In this embodiment, it is fixed to the casing 73 (developer recovery container) by its opposite edge from its scooping edge in terms of the widthwise direction. Further, in this embodiment, the image forming apparatus 10 is structured so that the area of contact between the scooping sheet 72 and photosensitive drum 1 is on the upstream side of the area of contact between the blade 71 and photosensitive drum 1, by 5 mm in terms of the rotational direction of the photosensitive drum 1. Next, referring to FIG. 2 (sectional view of image forming apparatus 10), an angle β, which is the angle between a straight line which is tangential to the peripheral surface of the photosensitive drum 1 at a point of contact between the scooping sheet 72 and peripheral surface of the photosensitive drum 1, and the surface of the scooping sheet 72, is set to 30 degrees. In this embodiment, the scooping sheet 72 is disposed so that its scooping edge, which is one of the longer edges of the scooping sheet 72 in terms of the widthwise direction, is on the top side of the other longer edge.

As described above, in this embodiment, the image forming apparatus 10 is structured so that as the photosensitive drum 1 is rotated, its peripheral surface moves upward at the point of contact between the photosensitive drum 1 and blade 71 in terms of the gravity direction; the scooping edge of the blade 71 is on the upstream side of its base portion; and as the photosensitive drum 1 is rotated, the liquid developer on the peripheral surface of the photosensitive drum 1 is scraped away by the blade 71. Then, the liquid developer scraped away (dammed up) by the blade 71 flows into the casing 73 (recovered toner container) as if it is scooped up by the scooping sheet 72 disposed on the bottom side of the blade 71 in terms of the gravity direction.

By the way, in this embodiment, the image forming apparatus 10 is structured so that the center of the photosensitive drum 1, center of the blade 71, and center of the scooping sheet 72, in terms of their lengthwise direction, align in the direction perpendicular to the lengthwise direction. Thus, of the two among the three elements mentioned above, the lengthwise edges of the shorter one are on the inward side of those of the longer one, in terms of the lengthwise direction.

The recovery container 73 is a container in which the liquid developer scraped away from the photosensitive drum 1 by the blade 71 is stored. It is structured so that the inward surface of its bottom wall gradually declines toward the rear (rear side of sheet of paper on which FIG. 2 is drawn). Thus, the liquid developer is made to flow into the recovered (waste) developer tank (unshown) by the gravity.

3. Blade Structure

Figure 1:
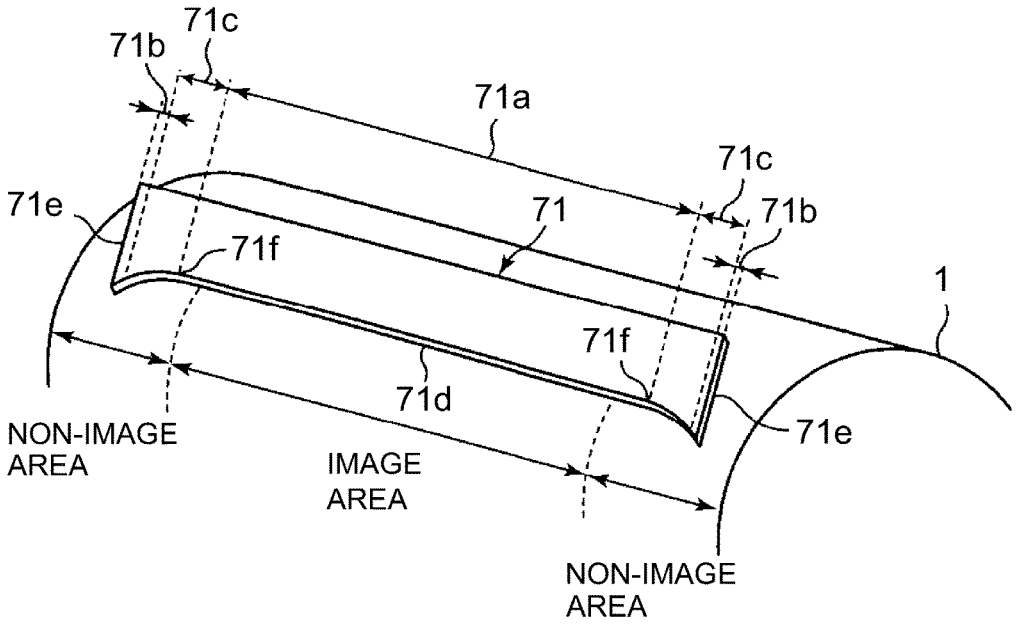
Figure 1:
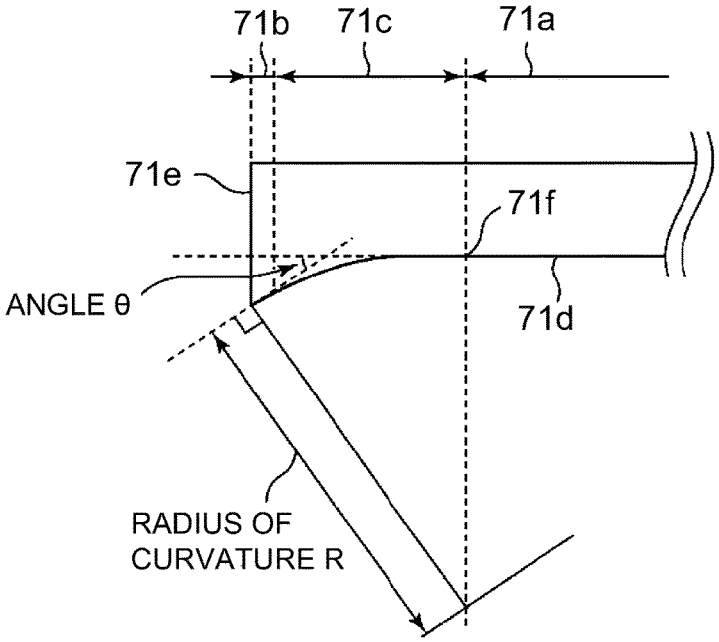

Next, the blade 71 in this embodiment is described in greater detail about its structure. Part (a) of FIG. 1 is a perspective view of the blade 71 (along with photosensitive drum 1) in this embodiment as it is seen from within the recovery container 73. Part (b) of FIG. 1 is a top view of one of the lengthwise end portions of the blade 71, and its adjacencies, in this embodiment. The lengthwise end portions of the blade 71 are the same in structure (shape), and are symmetrical with reference to the center of the blade 71 in terms of its lengthwise direction. Thus, only one of the lengthwise end portions of the blade 71 is described.

The blade 71 is disposed roughly in parallel to the rotational axis of photosensitive drum 1 so that its cleaning edge portion 71*d*, that is, one of its two edge portions which are roughly perpendicular to the widthwise direction of the blade 71, is placed in contact with the peripheral surface of the photosensitive drum 1. It is an elastic one-piece member. More precisely, in this embodiment, the blade 71 has four long edges and four short edges, and it is one of the two long edges which are on the photosensitive drum side in terms of the thickness direction of the blade 71, that is placed in contact with the peripheral surface of the photosensitive drum 1.

The cleaning edge portion 71*d* of the blade 71 (end surface of cleaning edge portion 71*d*) has a straight portion 71*a*, which is roughly linear, and which becomes roughly parallel to the rotational axis of photosensitive drum 1 as the blade 71 is attached to the recovery container 73. The straight portion 71*a* dams up (scrapes away) the liquid developer on the peripheral surface of the photosensitive drum 1. Further, the cleaning edge portion 71*d* of the blade 71 has a pair of slanted portions 71*b*, which extend from the lengthwise ends of the straight portion 71*a* at such an angle that the closer is a given point of the slanted portion to the lengthwise end of the blade 71, the more upstream it is in terms of the rotational direction of the photosensitive drum 1. As the liquid developer is dammed up by the straight portion 71*a*, some of it moves (migrates) toward the lengthwise end portions 71*e* of the blade 71. The slanted portion 71*b* prevents the liquid developer from reaching the lengthwise end portions 71*e*. Further, the cleaning edge portion 71*d* of the blade 71 has a pair of connective points at which the straight portion 71*a* and slanted portion 71*b* meet with each other.

The cleaning device 7 is structured so that the contact pressure between connective portion 71*c* and the peripheral surface of the photosensitive drum 1 is sufficient to satisfactorily dam up the liquid developer on the peripheral surface of the photosensitive drum 1. That is, the contact pressure between the connective portion 71*c* and the peripheral surface of the photosensitive drum 1 is greater than the smallest amount of contact pressure required between the blade 71 and photosensitive drum 1 for the blade 71 to satisfactorily dam up the liquid developer on the peripheral surface of the photosensitive drum 1. Further, the slanted portion 71*b* is given such a curvature that its angle (which hereafter may be referred to simply as "slant angle") relative to the theoretical extension of the straight portion 71*a* is largest at the lengthwise end portion 71*b*. By the way, normally, the contact pressure between the slanted portion 71*b* and the peripheral surface of the photosensitive drum 1 is greater than the contact pressure between the straight portion 71*a* and the peripheral surface of the photosensitive drum 1.

Further, the length of the straight portion 71*a* in terms of the lengthwise direction of the blade 71 is greater than the dimension of the image formation area of the photosensitive drum 1 in terms of the direction parallel to the rotational axis of photosensitive drum 1. Further, the image forming apparatus 10 is structured so that, in terms of the lengthwise direction of the cleaning device 7, a point of contact 71*f* between the straight portion 71*a* and slanted portion 71*b* is on the outward side of the image formation area of the photosensitive drum 1. The "image formation area" is the area of the image bearing member, in terms of the direction parallel to the rotational axis of photosensitive drum 1, across which an image can be formed with the use of liquid developer. The dimension of the image formation area of the photosensitive drum 1 in terms of the direction parallel to the rotational axis of photosensitive drum 1, corresponds to the dimension of the largest image transferable onto the longest sheet P of transfer medium, in terms of the direction which is roughly perpendicular to the transfer medium conveyance direction, across which an image can be formed by the image forming apparatus 10. By the way, the portion of the peripheral surface of the image bearing member, across which an image cannot be formed with the use of liquid developer, is referred to as "non-image area".

In this embodiment, as the connective portion 71*c* is seen from the direction which is roughly perpendicular to the thickness direction of the blade 71, the connective portion 71*c* has curvature. In particular, in this embodiment, as the blade 71 is seen from its thickness direction, the connective portion 71*c* has such a curvature that the theoretical extension of the straight portion 71*a* of the cleaning edge portion (71*d*) is tangential to the connective portion 71*c*, and also, that the lengthwise end of the straight portion 71*a* coincides with the point of contact 71*f* of connection between the straight portion 71*a* and connective portion 71*c*. Further, in this embodiment, it is desired that the angle of the slanted portion 71*b* is no less than 5 degrees, and also, that the slanted portion 71*b* is the lengthwise end portion of the cleaning edge portion 71*d* in terms of the lengthwise direction of the blade 71, as will be described later in detail.

4. Function of blade

Next, the blade 71 in this embodiment is described in greater detail about its function. As described above, the cleaning edge portion 71*d* of the blade 71 has the straight portion 71*a* which dams up (scrapes away) the liquid developer on the image formation area of the photosensitive drum 1. Further, the cleaning edge portion 71*d* of the blade 71 has the pair of slanted portions 71*b* which prevent the problem that as the liquid developer is dammed up by the straight portion 71*a*, it migrates toward the lengthwise end portions 71*e* (it horizontally moves). It has also the connective portion 71*c* which connects the straight portion 71*a* to the slanted portions 71*b*. The connective portion 71*c* is given such a curvature that the connective portion 71*c* gradually bends upstream, toward the slanted portion 71*b*, being enabled to maintain the preset amount of contact pressure between itself and the peripheral surface of the photosensitive drum 1.

Figure 3:
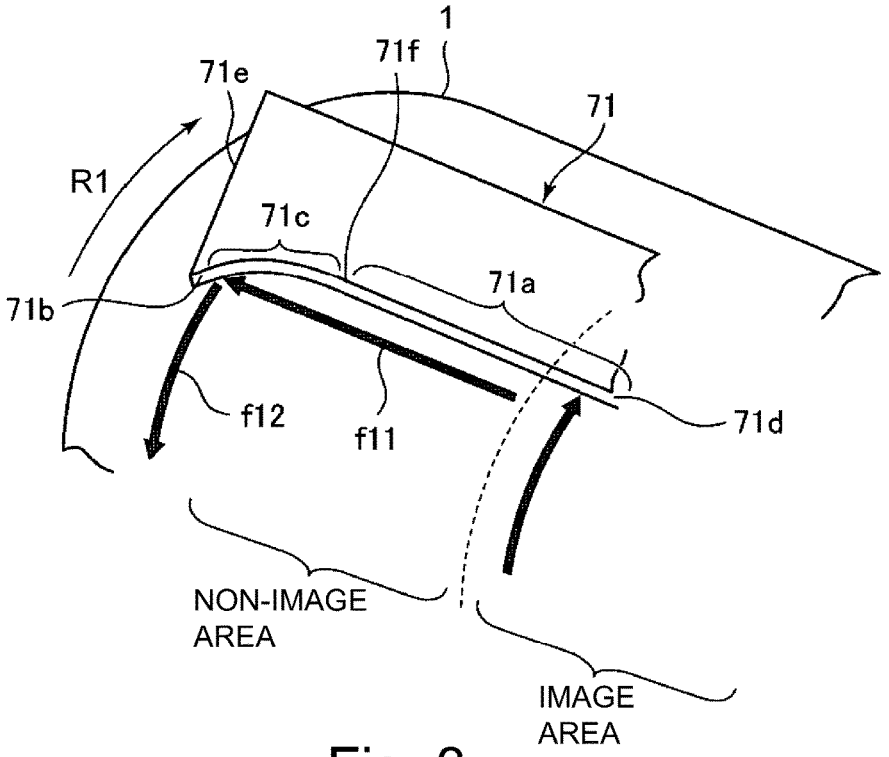
FIG. 3 is a schematic perspective view of one of the lengthwise end portions of the blade in the first embodiment, and its adjacencies; it is for showing the flow of liquid developer in the adjacencies of the lengthwise end portion of the blade.

FIG. 3 is a schematic perspective view of one of the lengthwise end portions 71*e* of the blade 71 in this embodiment, and its adjacencies. It is for showing the flow of the liquid developer in the adjacencies of the blade 71. The photosensitive drum 1 rotates in the direction indicated by an arrow mark R1 in FIG. 3. In the image formation area, a substantial portion of the liquid developer dammed up by the straight portion 71*a* of the blade 71 temporarily collects in the adjacencies of the straight portion 71*a* (on upstream side of the straight portion 71*a* in terms of rotational direction of photosensitive drum 1), and then, is made to flow down onto the scooping sheet 72, and, into the recovery container 73, by the gravity.

On the other hand, a part of the dammed up liquid developer remains in the adjacencies of the straight portion 71*a*, and flows into the non-image portion (inward by roughly 20 mm from lengthwise end portion 71*e*) of the photosensitive drum 1 (toward lengthwise end portions 71*e* of blade 71) along the straight portion 71*a*. The slanted portion 71*b* is tilted relative to the direction of the liquid developer movement indicated by an arrow mark f11. Thus, it reduces the liquid developer in the speed with which the liquid developer moves toward the slanted portion 71*b* (reduces liquid developer in its inertia). As described above, the slanted portion 71*b* has the function of pushing back the liquid developer as the liquid developer moves in the direction indicated by the arrow mark f11. The angle of the slanted portion 71*b* is optional as long as the slanted portion 71*b* is enabled to satisfactorily push back the liquid developer as described above. In this embodiment, the angle of the slanted portion 71*b* is 5 degrees.

As the liquid developer is reduced in the speed with which it moves in the direction indicated by the arrow mark f11, it collects in the adjacencies of the connective portion 71*c* (on upstream side of blade 71 in terms of rotational direction of photosensitive drum 1). As the liquid developer collects in the adjacencies of the connective portion 71*c*, it is made to flow down onto the scooping sheet 72, as indicated by an arrow mark f12, and collect in the recovery container 73, by the gravity. Therefore, the connective portion 71*c* has to be pressed on the peripheral surface of the photosensitive drum 1 so that the contact pressure between the connective portion 71*c* and peripheral surface of the photosensitive drum 1 is large enough to satisfactorily clean the peripheral surface of the photosensitive drum 1, like the contact pressure generated between the straight portion 71*a* and peripheral surface of the photosensitive drum 1. By making the angle of the connective portion 71*c* relative to the straight portion 71*a* seamlessly and gently change, it is possible to keep the contact pressure between the connective portion 71*c* and the peripheral surface of the photosensitive drum 1 roughly the same as that between the straight portion 71*a* and the peripheral surface of the photosensitive drum 1, and therefore, it is possible to prevent the problem that a certain amount of the liquid developer dammed up by the blade 71 escapes from the upstream side of the blade 71 to the downstream side. In this embodiment, as the blade 71 is seen from the direction parallel to its thickness direction, the connective portion 71*c* is given such curvature that the straight portion 71*a* is tangential to the connective portion 71*c* at the point of contact 71*f* of connection between the straight portion 71*a* and connective portion 71*c*. The radius of this curvature is 240 mm.

As described above, this embodiment utilizes the structure (shape) of the lengthwise end portions of the blade 71 to prevent liquid developer from migrating outward in the lengthwise direction of the cleaning device 7 beyond the lengthwise end portions 71*e* of the blade 71, in order to prevent the liquid developer from forming the aforementioned "liquid rings". However, in order to prevent liquid developer from leaking from the cleaning device 7 when the image forming apparatus 10 or a unit which includes the cleaning device 7 is moved, for example, a sealing member may be placed next to the lengthwise end portions 71*e* (end surface of blade 71). Even if the sealing member is provided, not only is liquid developer prevented by the blade 71 itself from migrating outward of the cleaning device 7 beyond the lengthwise end portion 71*e* of the blade 71, but also by the sealing member, while the image forming apparatus 10 is in operation. Therefore, it does not occur that when the image forming apparatus 10 is in operation, liquid developer leaks through the gap between the lengthwise end portion 71*e* (end surface of blade 71) and sealing member, and forms "liquid rings". It is also prevented that the sealing member is wetted by the liquid developer, and therefore, it is prevented that the peripheral surface of the photosensitive drum 1 is re-coated with the liquid developer from the wetted sealing member.

It is possible to provide the lengthwise end portions of the blade 71 with a groove (or grooves) to capture liquid developer, in order to prevent the formation of the "liquid rings". This kind of structural arrangement, however, is problematic in that if the liquid developer captured by the groove dries up in the groove, the groove can no longer capture liquid developer, and therefore, the "liquid rings" are formed. In comparison, in the case of this embodiment, as liquid developer migrates along the cleaning edge portion 71*d*, the combination of the connective portion 71*c* and slanted portion 71*b* of the cleaning edge portion 71*d* of the blade 71 simply catches liquid developer, and let the liquid developer flow in the gravity direction. Therefore, even if liquid developer adheres to the slanted portion 71*b* and dries, it does not occur that liquid developer passage is entirely blocked. Therefore, the above-described problem attributable to the conventional structural arrangement for a cleaning device does not occur.

Next, the results of the experiments carried out to compare the cleaning device in this embodiment with comparative cleaning devices 1~3 are described regarding the liquid developer leakage and the formation of liquid rings. In the experiments, while the photosensitive drum 1 was rotated at a peripheral velocity equal to that in an image forming operation, the peripheral surface of the photosensitive drum 1 was uniformly covered with liquid developer to a thickness of roughly 1 μm. Then, the liquid developer on the photosensitive drum 1 was dammed up by the blade 71 for roughly 10 minutes, while the lengthwise ends of the blade 71, and the portions of the peripheral surface of the photosensitive drum 1, which correspond in position to the lengthwise ends of the blade 71, were observed to confirm the presence or absence of the liquid rings.

The results of the experiments are shown in Table 1. part (a) of FIG. 4 is a schematic top view of one of the lengthwise end portion 71*e* of the blade 71 of the first example of comparative cleaning device, and its adjacencies; part (b) of FIG. 4, that of the second example of comparative cleaning device; and part (c) of FIG. 4 is a schematic top view of the lengthwise end portion 71*e*, and its adjacencies, of the third example of comparative cleaning device. The arrow marks in FIGS. 4, which show the directions of the liquid developer flows in the first to third examples of the comparative cleaning devices, and which are the same in direction as those in FIG. 3, are given the same referential codes as those given to the counterparts in FIG. 3. FIG. 5 is a graph which shows the distribution of the contact pressure between the portion of the cleaning edge portion 71*d*, which is adjacent to the lengthwise end portion 71*e*, and the peripheral surface of the photosensitive drum 1, in this embodiment, and first to third examples of comparative cleaning device. This distribution of contact pressure was calculated based on the structural simulation.

TABLE 1

| | Comp. Ex. 1 | Comp. Ex. 2 | Comp. Ex. 3 | Emb. 1 |
|---|---|---|---|---|
| Passing through | ○ (non) | X (yes) | X (yes) | ○ (non) |
| Liquid ring | X (yes) | ○ (non) | ○ (non) | ○ (non) |

In the first example of comparative cleaning device, the cleaning edge portion 71*d* of the blade 71 is provided with only the straight portion 71*a*. Further, the cleaning device is provided with a sealing member 80 formed of sponge. The sealing member 80 is provided with a surface which is placed in contact with the end surface (lengthwise end portion 71*e*) of the blade 71, and the end surface of the cleaning edge portion 71*d*. The sealing member 80 is disposed so that there is a gap (roughly 10 mm) between the sealing member 80 and the lengthwise end portion 71*e* of the blade 71, and a gap (roughly 10 mm) between the sealing member 80 and cleaning edge portion 71*d*, as in an electrophotographic image forming apparatus of the so-called dry type. Referring to Table 1, in the case of the first example of comparative cleaning device, the blade 71 satisfactorily dammed up toner (escaping did occur), but liquid rings were created. That is, in a case where the first example of comparative cleaning device was employed by an electrophotographic image forming apparatus of the dry-type, toner clogged up the gap between the sealing member 80 and blade 71, preventing thereby toner from leaking thereafter. However, in a case where the first example of comparative cleaning device is employed by an image forming apparatus of the so-called wet-type, liquid developer leaked through the gap between the sealing member 80 and blade 71 as indicated by an arrow mark f13 in part (a) of FIG. 4, and formed a liquid ring. Further, if the sealing member 80 absorbs a substantial amount of liquid developer, the re-coating occurs; the sealing member 80 continues to coat the peripheral surface of the photosensitive drum 1 with liquid developer.

By the way, even if the sealing member 80 is placed in contact with the lengthwise end portion 71*e* and cleaning edge portion 71*d*, liquid rings occur as described above, and if the sealing member 80 absorbs a substantial amount of liquid developer, re-coating occur. That is, even if the sealing member 80 is placed in contact with the blade 71, there are still minute gaps between the sealing member 80 and blade 71. Therefore, the same phenomenon as that caused by the first example of comparative cleaning device occurs.

In the case of the second example of comparative cleaning device, the blade 71 is not provided with the connective portion 71*c*, with which the cleaning device 7 in the first embodiment is provided. That is, the straight portion 71*a* of the cleaning edge portion 71*d* is directly in connection to the slanted portion 71*b*. The angle of the slanted portion 71*b* relative to the straight portion 71*a* is 5 degrees. Referring to Table 1, in the case of the second example of comparative cleaning device, no liquid ring occurred, but a certain amount of liquid developer escaped to the downstream side of the blade 71 as indicated byarrow f14. The reason for the occurrence of escaping is as follows. That is, in the case of the second example of comparative cleaning device, the angle between the straight portion 71*a* and slanted portion 71*b* is substantial. Therefore, the blade 71 cannot generate a preset amount of contact pressure, which is necessary for satisfactory cleaning, in the adjacencies of the point of connection between the slanted portion 71*b* and straight portion 71*a*, as shown in FIG. 5 (plotted by Δ) (contact pressure is smaller in value than the value of the lowest end of the satisfactory contact pressure range. This seems to be the reason why a certain amount of liquid developer escaped to the downstream side of the blade 71.

In the case of the third example of comparative cleaning device, the blade 71 is provided with the straight portion 71*a*, a pair of connective portions 71*c*, and a pair of slanted portion 71*b*. Further, each connective portions 71*c* is made up of three straight portions 71*c*1, 71*c*2 and 71*c*3, which are different in their angle relative to the straight portion 71*a*. That is, in terms of the angle relative to the straight portion 71*a*, the straight portion 71*c*1 is greater than the straight portion 71*c*2, which is greater than the straight portion 71*c*3. In the case of the third example of comparative cleaning device, the angle of the slanted portion 71*b* is 5°. In particular, in the case of the third example of comparative cleaning device, the connective portion 71*c* of the blade 71 is divided into three subsections (roughly equal in length) in terms of its lengthwise direction, and the three subsections are angled so that the closer they are to the straight portion 71*a*, the greater they are in the angle relative to the straight portion 71*a*. In other words, the portion of the blade 71 between the point of contact 71*f* of connection and the lengthwise end portion 71*e* is divided into four subsections (roughly equal in length), and the combination of the three subsections which are closer to the point of contact 71*f* of connection was considered to be equivalent to the connective portion 71*c*. That is, in the third example of comparative cleaning device, the angle between the adjacent two subsections of the connective portion 71*c* is equal to a quarter of the angle of the slanted portion 71*b* relative to the straight portion 71*a*. Referring again to Table 1, in the case of the third example of comparative cleaning device, no liquid ring occurred. However, a certain amount of liquid developer escaped, as indicated by arrow f14. The reason for this escaping is as follows: In the case of the third example of comparative cleaning device, the connective portion 71*c* was made up of three straight subsections. Therefore, the angle between the adjacent two subsections of the connective portion 71*c* is less than the angle between the slanted portion 71*b* and straight portion 71*a* in the second comparative cleaning device. Yet, the angle between the adjacent two subsections of the connective portions 71*c* is relatively large. Therefore, the contact pressure generated by the cleaning edge portion 71*d* at the point of connection between the adjacent two subsections, and in the adjacencies of the point of contact, is not large enough to satisfactorily clean the peripheral surface of the photosensitive drum 1 (contact pressure is below required pressure range), as shown in FIG. 5 (plotted by ○). This seems to be the reason why a certain amount of liquid developer escaped to the downstream side of the blade 71.

By the way, the results of the experiments in which cleaning devices, the connective portion 71*c* of which was made up of four or more straight subsections, were tested, revealed that as long as the connective portion 71*c* is divided into four or more straight subsections, the angle between the adjacent two subsections is small enough for the cleaning edge portion 71*d* to generate contact pressure necessary for satisfactory cleaning, even at the point of connection between the adjacent two subsections, and its adjacencies. FIG. 6 shows a cleaning blade 71, the connective portion 71*c* of which is made up of four straight subsections 71*c*1-71*c*4, (roughly equal in length), in terms of the lengthwise direction of the connective portion 71*c*. In other words, in the case of the blade 71 shown in FIG. 6, the portion of the blade 71, which is between the point of contact 71*f* of connection to the lengthwise end portion 71*e* in terms of the lengthwise direction of the blade 71 is divided into five straight subsections (roughly equal in length), and the combination of the four subsections which are on the point of contact 71*f* of connection side is equivalent to the connective portion 71*c* in the first embodiment. That is, all that is required is that the angle between the adjacent two straight subsections of the connective portion 71*c* is smaller than a quarter of the angle of the slanted portion 71*b* relative to the straight portion 71*a*. It is desired, however, that the multiple (five) straight subsections are equal in their angle relative to the adjacent ones, and also, that their angle is small enough to make the connective portion 71*c* appear as if it has curvature.

As described above, in this embodiment, the angle of the slanted portion 71*b* is 5°, and the connective portion 71*c* has such a curvature that is 240 mm in radius. Next, referring to Table 1, in the case of this embodiment, neither did the escaping of liquid developer, nor the formation of liquid rings occur. The reason why the escaping did not occur is that the blade 71 was shaped so that the angle between the adjacent two straight subsection of its connective portion 71*c* was relatively small, and therefore, the blade 71 generated a preset amount of contact pressure necessary for successful cleaning across the connective portion 71*c* as shown in FIG. 5 (plotted with ■). As for the liquid developer which does not escape to the downstream side of the connective portion 71*c* and migrates to the slanted portion 71*b*, it is pushed back by the slanted portion 71*b*. That is, it is prevented from flowing (migrating) toward the lengthwise end portion 71*e* of the blade 71. Then, it is made to flow downward on the scooping sheet 72 by the gravity, and isrecovered into the recovery container 73. Therefore, liquid ring is not formed.

Next, the angle of the slanted portion 71*b* relative to the straight portion 71*a*, and the radius of curvature of the connective portion 71*c*, are described in greater detail. Here, the angle of slanted portion 71*b* means the angle between the theoretical extension of the straight portion 71*a* toward the lengthwise end portion 71*e* of the blade 71, and the theoretical extension of the slanted portion 71*b* toward the theoretical extension of the straight portion 71*a* (angle θ in part (b) of FIG. 1). Table 2 shows the results of experiments.

TABLE 2

| | Structure 1 | Structure 2 | Structure 3 |
|---|---|---|---|
| Radius of curvature | 160 ± 0.1 mm | 160 ± 0.1 mm | 240 ± 0.1 mm |
| Inclination set (central value) (degrees) | 4.9 | 6.3 | 5.2 |
| Passing through | X (yes) | X (yes) | ○ (non) |
| Liquid ring | X (yes) | ○ (non) | ○ (non) |

The results of the testing of three blades 71 which were different in the angle of slanted portion 71*b* indicate the following: in a case where the angle was no more than 5°, liquid rings were formed (structure (1)). In a case where the angle was no less than 5°, no liquid ring was formed (structures (2) and (3)). By the way, from the standpoint of preventing the blade 71 from reducing in the contact pressure between connective portion 71*c* and peripheral surface of the photosensitive drum 1, it is undesirable to make the angle greater than necessary. In this embodiment, the angle is desired to be no more than eight degrees. Further, the three blades 71 were made different in the radius of curvature of their connective portion 71*c*. In a case where the radium of curvature was 160 mm, a certain amount of liquid developer escaped to the downstream side of the blade 71 (structures (1) and (2)). In comparison, in a case where the radius of curvature was 240 mm, the escaping did not occur (structure (3)). By the way, as long as the connective portion 71*c* is made greater than 160 mm in radius of curvature, it is possible to prevent the formation of liquid rings, although it depends on how perfectly the formation of liquid ring is to be prevented. From the standpoint of ensuring that there is absolutely no escaping, the connective portion 71*c* is desired to be no less than 240 mm in radius of curvature. By the way, from the standpoint of reducing a cleaning device in size, it is undesirable to make the connective portion 71*c* unnecessarily large in radius of curvature. In this embodiment, it is desired to be no more than 320 mm.

By the way, the blade 71 sometimes has to be altered in the angle of the slanted portion 71*b*, and the radius of curvature of the connective portion 71*c*, which were described above, according to the diameter of the photosensitive drum 1, hardness and/or thickness of the blade 71, and condition under which the blade 71 is placed in contact with the peripheral surface of the photosensitive drum 1. The aforementioned values for the various parameters, for example, the angle of the slanted portion 71*b*, and the radius of curvature of the connective portion 71*c*, to begin with, are nothing but average values (which include such representative values that include center values) for the parameters. In other words, the values for the various parameters includes those which have a tolerable amount of error. Although this embodiment is not intended to limit the present invention in scope in terms of the angle of the slanted portion 71*b*. That is, the angle of the slanted portion 71*b* may be different from the preset one as long as the difference is no more than ±0.1 degree, and the radius of curvature of the connective portion 71*c* may be different from the preset one as long as the difference is no more than 0.1 mm.

As described above, not only can this embodiment prevent liquid developer from escaping to the downstream side of the blade 71, but also, can prevent liquid developer from migrating outward of the cleaning device 7 beyond the lengthwise end portion 71*e* of the blade 71, and therefore, can prevent the formation of liquid rings.

[Embodiment 2]

Next, another embodiment of the present invention is described. In terms of basic structure and operation, the image forming apparatus in this embodiment is the same as the image forming apparatus in the first embodiment. Thus, the elements of the image forming apparatus in this embodiment, which are the same as, or correspondent to, the counterparts in the first embodiment in function and/or structure are given the same referential codes as those given to the counterparts, and are not described in detail.

In this embodiment, the process speed was 800 mm/s, and the carrier liquid was 4 cp in viscosity. It is sometimes desired that the slanted portion 71*b* is changed in angle according to the process speed and/or the viscosity of the carrier liquid. The angle which the slanted portion 71*b* is required to push back liquid developer as the liquid developer flows toward the lengthwise end portion 71*e* of the blade 71 is affected by the process speed and/or the viscosity of the carrier liquid, as will be described next.

It is thought that the speed (which hereafter may be referred to as "horizontal speed") with which liquid developer moves toward the lengthwise end portion 71*e* of the blade 71 is determined by the ratio between the amount by which liquid developer horizontally moves, and the amount by which liquid developer is made to flow toward the scooping sheet 72 by the gravity. The amount by which liquid developer horizontally moves is proportional to the thickness of the liquid developer layer (which hereafter may be referred to as liquid film) which the blade 71 encounters, and the process speed. Further, the thickness of the liquid film which the blade 71 encounters is determined by the height (thickness) of the liquid film which moves through the gap between the photosensitive drum 1 and the other members before the liquid developer film reaches the blade 71. Generally speaking, the height (thickness) of the liquid film which is allowed to move through the nip between two objects is proportional to the average peripheral velocity v of the two objects and the viscosity $\eta$ of the liquid. Further, it is inversely proportional to the amount of load to which the liquid film is subjected in the nip. In the case of an image forming apparatus, this average peripheral velocity may be thought to be equal to the process speed of the image forming apparatus. By the way, in this embodiment, the load to which the liquid film is subjected may be represented by the load (internal pressure) of the transferring portion N. Thus, the horizontal speed of the liquid developer is expressed by the following formula:

$$\text{Horizontal speed} \propto \text{viscosity} \times (\text{process speed})^2 \div \text{load}.$$

On the other hand, the speed (which hereafter may be referred to as "push-back speed") with which liquid developer is pushed back by the slanted portion 71*b* is proportional to the process speed. That is, the push-back speed is expressible by the following formula:

$$\text{Push-back speed} \propto \text{process speed}.$$

The lowest value for the angle of which the slanted portion 71*b* is required to push back liquid developer, and also, to force the liquid developer to flow toward the scooping sheet 72 is obtainable from the balance between the speed (which hereafter will be referred to as "horizontal speed in BLD direction") with which liquid developer moves toward the lengthwise end portion 71*e* along the slanted portion 71*b*, and the speed (which hereafter will be referred to as "push-back speed in BLD direction") with which liquid developer is pushed back by the slanted portion 71*b* along the slanted portion 71*b*. That is, referring to FIG. 7 which is for schematically showing this concept, the minimum value is expressible by the following formula:

$$\text{Push-back speed} = \text{horizontal speed in BLD direction}$$

provided that $$\text{Horizontal speed in BLD direction} = \text{horizontal speed} \times \cos\theta$$

$$\text{Push-back speed in BLD direction} = \text{process speed} \times \sin\theta.$$

Therefore, $$\text{Push-back speed} \times \sin\theta = \text{horizontal speed} \times \cos\theta$$

$$\tan\theta = \text{horizontal speed} \div \text{process speed}.$$

Therefore, it can be said that the angle θ of the slanted portion 71*b* has to be increased in proportion to the process speed and the viscosity of liquid, and is inversely proportional to the load, and therefore, it is expressible in the following formula:

$$\tan\theta \propto \text{process speed} \times \text{viscosity} \div \text{load}$$

Based on this principle, the minimum value for the angle of which the slanted portion 71*b* is required under a relatively severe condition, that is, a condition that the minimum value of which the angle of the slanted portion 71*b* is required to satisfactorily push back liquid developer as the liquid developer moves in the horizontal direction, is estimated. By the way, the amount of load is estimated to be 50 N (which is roughly the same as load of transferring portion N in first embodiment), which is relatively severe condition, that is, a condition that makes relatively thick, the liquid film on the peripheral surface of the photosensitive drum 1, which reaches the blade 71.

For example, there are situations in which liquid (carrier liquid) needs to be higher in viscosity than the one in the first embodiment, in consideration of the permeability of the liquid into the structural members and media (transfer medium P). In such situations, the angle of which the slanted portion 71*b* is required has to be increased in proportion to the amount of increase in the viscosity of the liquid. For example, in a case where the process speed is 800 mm/s, and the carrier liquid is 20 cp in viscosity, the angle of the slanted portion 71*b* is desired to be no less than 25 degrees.

Further, there are situations in which an image forming apparatus has to be increased in process speed from the standpoint of productivity. In such situations, the angle of which the slanted portion 71*b* is required has to be also increased in proportion to the increase in the process speed. For example, in a case where the process speed is 2000 mm/s, and the carrier liquid is 20 cp in viscosity, the angle of the slanted portion 71*b* is desired to be no less than 50 degrees.

By increasing the blade 71 in the angle of its slanted portion 71*b* based on the process speed and/or the viscosity of the carrier liquid, it is possible to prevent the escaping of liquid developer, while preventing the formation of liquid rings.

[Others]

In the embodiments described above, the object to be cleaned by the cleaning device was the photosensitive drum 1. However, these embodiments are not intended to limit the present invention in scope in terms of the object to be cleaned. For example, some of image forming apparatuses such as the image forming apparatus 10 in the preceding embodiments are equipped with a cleaning device for removing the liquid developer having adhered to the transfer roller 5 (rotational member), and recovering the removed liquid developer. FIG. 8 is a schematic sectional view of another electrophotographic image forming apparatus of the wet-type. The elements of the image forming apparatus in FIG. 8, which are the same as, or correspondent to, the counterpartsof the image forming apparatus 10 in FIG. 2, in function or structure, are given the same referential codes as the counterparts. In the case of the image forming apparatus 10 in FIG. 8, the toner image formed on the peripheral surface of the photosensitive drum 1 is transferred (primary transfer) onto an intermediary transfer roller 11 as an intermediary transferring member. Then, this toner image is transferred (secondary transfer) onto a sheet P of transfer medium by the function of a secondary transfer roller 12 as the secondary transferring means, in the secondary transferring portion N2. Some image forming apparatuses such as the image forming apparatus 10 in FIG. 8 are provided with a cleaning device 13 for removing the liquid developer remaining on the intermediary transfer roller 11 as a rotational member, and recovering the removed liquid developer. The present invention is also applicable to the cleaning devices for those image forming apparatuses, and the application can provide the same effects as those obtainable by the embodiments described above. That is, the present invention is applicable to any cleaning device as long as the cleaning device has a cleaning blade which is placed in contact with the peripheral surface of a rotational member for bearing liquid developer, in order to scrape away the liquid developer from the peripheral surface of the rotational member.

Further, the application of the present invention is not limited to cleaning devices for cleaning such a rotational member as a drum and a roller. For example, the present invention is also applicable to cleaning devices for cleaning a rotatable endless belt suspended and tensioned by two or more rollers.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-093324 filed on May 9, 2017, which is hereby incorporated by reference herein in its entirety.

What is claimed is:

1. A plate-like cleaning blade of elastic member capable of removing deposited matter from an image bearing member carrying a liquid developer, said cleaning blade comprising:

a free end surface provided at one end portion with respect to a height direction of said cleaning blade which is perpendicular to a longitudinal direction of said cleaning blade and to a thickness direction of said cleaning blade, said free end surface being provided with an edge portion at one end portion of said free end surface with respect to the thickness direction, wherein said edge portion has a curved portion extending from each end portion of said edge portion with respect to the longitudinal direction in a predetermined range, and a linear portion extending in the longitudinal direction between said curved portions and connecting with said curved portions at respective connecting positions, and wherein when said cleaning blade is viewed in the thickness direction:

a) said curved portion includes a portion having an arcuate shape, b) said curved portion is connected with said linear portion such that said linear portion is tangential of the arcuate shape, c) a height of said cleaning blade measured in the height direction in the range in which said curved portion is provided increases toward the end portion of said cleaning blade, d) a maximum angle formed between said curved portion and said linear portion is not less than 5 degrees, and e) said curved portion includes a portion having a radius of curvature not less than 240 mm and not more than 320 mm.

2. A cleaning blade according to claim 1, wherein the maximum angle is not less than 25 degrees.

3. A cleaning blade according to claim 1, wherein the maximum angle is not less than 50 degrees.

4. A cleaning device capable of removing deposited matter from an image bearing member carrying a liquid developer, said cleaning device comprising:

a plate-like cleaning blade of elastic member, said cleaning blade including a free end surface provided at one end portion with respect to a height direction of said cleaning blade which is perpendicular to a longitudinal direction of said cleaning blade and to a thickness direction of said cleaning blade, said free end surface being provided with an edge portion at one end portion of said free end surface with respect to the thickness direction; and a container portion for temporarily containing the liquid developer removed by said cleaning blade, wherein said edge portion has a curved portion extending from each end portion of said edge portion with respect to the longitudinal direction in a predetermined range, and a linear portion extending in the longitudinal direction between said curved portions and connecting with said curved portions at respective connecting positions, and wherein when said cleaning blade is viewed in the thickness direction:

a) said curved portion includes a portion having an arcuate shape, b) said curved portion is connected with said linear portion such that said linear portion is tangential of the arcuate shape, c) a height of said cleaning blade measured in the height direction in the range in which said curved portion is provided increases toward the end portion of said cleaning blade, d) a maximum angle formed between said curved portion and said linear portion is not less than 5 degrees, and e) said curved portion includes a portion having a radius of curvature not less than 240 mm and not more than 320 mm.

5. A cleaning device according to claim 4, wherein the maximum angle is not less than 25 degrees.

6. A cleaning device according to claim 4, wherein the maximum angle is not less than 50 degrees.

7. An image forming apparatus using a liquid developer, said apparatus comprising:

a movable image bearing member;

an image forming portion for forming a toner image on said image bearing member using the liquid developer;

a plate-like cleaning blade of elastic member having an edge portion contacted to said image bearing member at a contact portion and configured to remove a deposited matter from said image bearing member with movement of said image bearing member, wherein said cleaning blade includes a free end surface provided at one end portion with respect to a height direction of said cleaning blade which is perpendicular to a longitudinal direction of said cleaning blade and to a thickness direction of said cleaning blade, said free end surface being provided with said edge portion at one end portion of said free end surface with respect to the thickness direction; and a container portion for temporarily containing the liquid developer removed by said cleaning blade, wherein said edge portion has a curved portion extending from each end portion of said edge portion with respect to the longitudinal direction in a predetermined range, and a linear portion extending in the longitudinal direction between said curved portions and connecting with said curved portions at respective connecting positions, and wherein when said cleaning blade is viewed in the thickness direction:

a) said curved portion includes a portion having an arcuate shape, b) said curved portion is connected with said linear portion such that said linear portion is tangential of the arcuate shape, c) a height of said cleaning blade measured in the height direction in the range in which said curved portion is provided increases toward the end portion of said cleaning blade, d) a maximum angle formed between said curved portion and said linear portion is not less than 5 degrees, and e) said curved portion includes a portion having a radius of curvature not less than 240 mm and not more than 320 mm.

8. An apparatus according to claim 7, wherein said cleaning blade contacts said image bearing member such that an outward normal line at said free end surface has a component in a direction from a downstream side toward an upstream side with respect to the moving direction of said image bearing member at the contact portion.

9. An apparatus according to claim 7, wherein said cleaning blade contacts said image bearing member such that an outward normal line at said free end surface has a vertically downward component.

10. An apparatus according to claim 7, wherein said image bearing member includes a longitudinal image region in which said image forming portion is capable of forming a toner image and a non-image area longitudinally outside said image region, and wherein an entirety of said curved portion is disposed correspondingly to the non-image area in the longitudinal direction.

11. A plate-like cleaning blade of elastic member capable of removing deposited matter from an image bearing member carrying a liquid developer, said cleaning blade comprising:

a free end surface provided at one end portion with respect to a height direction of said cleaning blade which is perpendicular to a longitudinal direction of said cleaning blade and to a thickness direction of said cleaning blade, said free end surface being provided with an edge portion at one end portion of said free end surface with respect to the thickness direction, wherein said edge portion has an inclined portion extending from each end portion of said edge portion with respect to the longitudinal direction in a predetermined range, and a linear portion extending in the longitudinal direction between said inclined portions and connecting with said inclined portions at respective connecting positions, and wherein when said cleaning blade is viewed in the thickness direction:

a) an inclined portion is provided by serially connecting N linear connecting portions, where N is not less than 4, b) a height of said cleaning blade measured in the height direction in the range in which said inclined portion is provided increases toward the end portion of said cleaning blade, c) the connecting portion at a position closer to the end portions of said cleaning blade is inclined more relative to said linear portion, d) an angle formed between adjacent connecting portions is smaller than an angle of the connecting portion closest to the end portions of said cleaning blade in the longitudinal direction relative to the linear portion divided by N−1, and e) an angle of the connecting portion closest to the end portions relative to the linear portion is not less than 5 degrees.

12. A cleaning blade according to claim 11, wherein the angle of the connecting portion closest to the end portions relative to the linear portion is not less than 25 degrees.

13. A cleaning blade according to claim 11, wherein the angle of the connecting portion closest to the end portions relative to the linear portion is not less than 50 degrees.

14. A cleaning device capable of removing deposited matter from an image bearing member carrying a liquid developer, said cleaning device comprising:

a plate-like cleaning blade of elastic member, said cleaning blade including a free end surface provided at one end portion with respect to a height direction of said cleaning blade which is perpendicular to a longitudinal direction of said cleaning blade and to a thickness direction of said cleaning blade, said free end surface being provided with an edge portion at one end portion of said free end surface with respect to the thickness direction; and a container portion for temporarily containing the liquid developer removed by said cleaning blade, wherein said edge portion has an inclined portion extending from each end portion of said edge portion with respect to the longitudinal direction in a predetermined range, and a linear portion extending in the longitudinal direction between said inclined portions and connecting with said inclined portions at respective connecting positions, and wherein when said cleaning blade is viewed in the thickness direction:

a) an inclined portion is provided by serially connecting N linear connecting portions, where N is not less than 4, b) a height of said cleaning blade measured in the height direction in the range in which said inclined portion is provided increases toward the end portion of said cleaning blade, c) the connecting portion at a position closer to the end portions of said cleaning blade is inclined more relative to said linear portion, d) an angle formed between adjacent connecting portions is smaller than an angle of the connecting portion closest to the end portions of said cleaning blade in the longitudinal direction relative to the linear portion divided by (N−1), and e) an angle of the connecting portion closest to the end portions relative to the linear portion is not less than 5 degrees.

15. A cleaning device according to claim 14, wherein the angle of the connecting portion closest to the end portions relative to the linear portion is not less than 25 degrees.

16. A cleaning device according to claim 14, wherein the angle of the connecting portion closest to the end portions relative to the linear portion is not less than 50 degrees.

17. An image forming apparatus using a liquid developer, said apparatus comprising:

a movable image bearing member;

an image forming portion for forming a toner image on said image bearing member using the liquid developer;

a plate-like cleaning blade of elastic member having an edge portion contacted to said image bearing member at a contact portion and configured to remove a deposited matter from said image bearing member with movement of said image bearing member, wherein said cleaning blade includes a free end surface provided at one end portion with respect to a height direction of said cleaning blade which is perpendicular to a longitudinal direction of said cleaning blade and to a thickness direction of said cleaning blade, said free end surface being provided with said edge portion at one end portion of said free end surface with respect to the thickness direction; and a container portion for temporarily containing the liquid developer removed by said cleaning blade, wherein said edge portion has an inclined portion extending from each end portion of said edge portion with respect to the longitudinal direction in a predetermined range, and a linear portion extending in the longitudinal direction between said inclined portions and connecting with said inclined portions at respective connecting positions, and wherein when said cleaning blade is viewed in the thickness direction:

a) an inclined portion is provided by serially connecting N linear connecting portions, where N is not less than 4, b) a height of said cleaning blade measured in the height direction in the range in which said inclined portion is provided increases toward the end portion of said cleaning blade, c) the connecting portion at a position closer to the end portions of said cleaning blade is inclined more relative to said linear portion, d) an angle formed between adjacent connecting portions is smaller than an angle of the connecting portion closest to the end portions of said cleaning blade in the longitudinal direction relative to the linear portion divided by (N−1), and e) an angle of the connecting portion closest to the end portions relative to the linear portion is not less than 5 degrees.

18. An apparatus according to claim 17, wherein said cleaning blade contacts said image bearing member such that an outward normal line at said free end surface has a component in a direction from a downstream side toward an upstream side with respect to the moving direction of said image bearing member at the contact portion.

19. An apparatus according to claim 17, wherein said cleaning blade contacts said image bearing member such that an outward normal line at said free end surface has a vertically downward component.

20. An apparatus according to claim 17, wherein said image bearing member includes a longitudinal image region in which said image forming portion is capable of forming a toner image and a non-image area longitudinally outside said image region, and wherein an entirety of said inclined portion is disposed correspondingly to the non-image area in the longitudinal direction.

* * * * *